US012318883B2

(12) United States Patent
Boller et al.

(10) Patent No.: US 12,318,883 B2
(45) Date of Patent: Jun. 3, 2025

(54) DOUBLE-SIDE OR ONE-SIDE MACHINE TOOL

(71) Applicant: Lapmaster Wolters GmbH, Rendsburg (DE)

(72) Inventors: Hans-Peter Boller, Fockbek (DE); Ingo Neuber, Bornstein (DE)

(73) Assignee: Lapmaster Wolters GmbH, Rendsburg (DE)

( * ) Notice: Subject to any disclaimer, the term of this patent is extended or adjusted under 35 U.S.C. 154(b) by 0 days.

(21) Appl. No.: 17/672,825

(22) Filed: Feb. 16, 2022

(65) Prior Publication Data

US 2022/0258300 A1 Aug. 18, 2022

(30) Foreign Application Priority Data

Feb. 17, 2021 (DE) ..... 10 2021 103 709.3

(51) Int. Cl.
*B24B 37/08* (2012.01)
*B24B 7/17* (2006.01)
(Continued)

(52) U.S. Cl.
CPC ..... *B24B 37/08* (2013.01); *B24B 7/17* (2013.01); *B24B 37/015* (2013.01); *B24B 37/28* (2013.01); *B24B 49/14* (2013.01)

(58) Field of Classification Search
CPC ..... B24B 37/08; B24B 37/10; B24B 37/102; B24B 37/107; B24B 37/04; B24B 37/042;
(Continued)

(56) References Cited

U.S. PATENT DOCUMENTS 819,656 A * 5/1906 Hopflinger ..... F16C 33/3868 384/531
3,603,042 A * 9/1971 Boettcher ..... B24B 37/102 451/449
(Continued)

FOREIGN PATENT DOCUMENTS

CN 201907053 U 7/2011
CN 102884612 A 1/2013
(Continued)

OTHER PUBLICATIONS

Translation of WO 2010150757 A1 (Year: 2010).*
(Continued)

*Primary Examiner* — Tom Rodgers
*Assistant Examiner* — Steven Huang
(74) *Attorney, Agent, or Firm* — Barclay Damon LLP

(57) ABSTRACT

A machine tool includes a first support disk and a first working disk. The first working disk defines a clamping surface and is fastened to the first support disk. A counter bearing element is positioned relative to the first working disk such that a working gap is formed between the first working disk and the counter bearing element and is dimensioned to accept a flat workpiece. A first clamping arrangement clamps the clamping surface of the first working disk to the first support disk such that the clamping surface faces away from the working gap. At least one decoupling element is positioned to at least one decoupling element configured to reduce friction between the first support disk and the first working disk.

11 Claims, 2 Drawing Sheets

(51) Int. Cl.
*B24B 37/015* (2012.01)
*B24B 37/28* (2012.01)
*B24B 49/14* (2006.01)

(58) Field of Classification Search
CPC ..... B24B 37/015; B24B 37/12; B24B 7/228; B24B 49/14; B24B 55/02
See application file for complete search history.

(56) References Cited

U.S. PATENT DOCUMENTS

| | | | | | |
|---|---|---|---|---|---|
| 5,400,547 | A * | 3/1995 | Tanaka | B24B 37/12 | 451/287 |
| 5,441,442 | A * | 8/1995 | Haisma | B24B 37/12 | 451/63 |
| 5,782,678 | A * | 7/1998 | Cesna | B24B 41/02 | 451/291 |
| 6,299,514 | B1 * | 10/2001 | Boller | B24B 37/08 | 451/60 |
| 6,361,081 | B1 * | 3/2002 | Yokoyama | F16K 27/003 | 285/124.3 |
| 7,367,867 | B2 | 5/2008 | Boller | | |
| 2003/0003850 | A1 | 1/2003 | Eaton | | |
| 2003/0068958 | A1 | 4/2003 | Albrecht et al. | | |
| 2008/0311823 | A1 * | 12/2008 | Aiyoshizawa | B24B 37/015 | 451/7 |
| 2010/0190417 | A1 | 7/2010 | Watanabe et al. | | |
| 2012/0220197 | A1 * | 8/2012 | Boller | B24B 37/08 | 451/36 |
| 2012/0227765 | A1 | 9/2012 | Guerkink | | |
| 2014/0170781 | A1 * | 6/2014 | Albrecht | H01L 21/30625 | 451/364 |
| 2014/0170938 | A1 | 6/2014 | Duescher | | |
| 2017/0225292 | A1 * | 8/2017 | Boller | B24B 49/14 | |

FOREIGN PATENT DOCUMENTS

| | | | | | |
|---|---|---|---|---|---|
| CN | 107042432 | A | | 8/2017 | |
| CN | 110744440 | A | * | 2/2020 | |
| CN | 111823120 | A | * | 10/2020 | |
| DE | 19954355 | A1 | | 5/2001 | |
| DE | 10007390 | B4 | | 11/2008 | |
| DE | 102004040429 | B4 | | 12/2009 | |
| DE | 102006037490 | B4 | | 4/2011 | |
| DE | 102016102223 | A1 | | 8/2017 | |
| EP | 1252974 | A2 | | 10/2002 | |
| EP | 1366854 | A1 | * | 12/2003 | B24B 37/08 |
| EP | 1252974 | A3 | | 1/2004 | |
| EP | 3974108 | A1 | | 3/2022 | |
| FR | 2549198 | A1 | * | 1/1985 | |
| JP | 1992365554 | A | | 12/1992 | |
| JP | H04365554 | | | 12/1992 | |
| JP | 2002273652 | A | | 9/2002 | |
| JP | 2002326155 | A | | 11/2002 | |
| JP | 2003011055 | A | | 1/2003 | |
| JP | 2004237373 | A | | 8/2004 | |
| TW | 589237 | B | | 6/2004 | |
| WO | WO-2010150757 | A1 | * | 12/2010 | B24B 37/08 |
| WO | 2020/208968 | A1 | | 10/2020 | |

OTHER PUBLICATIONS

Translation of CN 110744440 A (Year: 2020).*
Translation of EP 1366854 A1 (Year: 2003).*
Translation of CN 111823120 A (Year: 2020).*
Translation of FR 2549198 A1 (Year: 1985).*
EP 20220150764, filed Jan. 10, 2022, European Search Report dated Jul. 7, 2022 (8 pages).
TW 20220101119, filed Jan. 11, 2022, Taiwan Office Action dated Mar. 10, 2023 (15 pages).
Japanese Patent Office, Office Action from Japanese Patent Application No. P2022-008879, mailed May 10, 2023 with English language translation (total 17 pages).
CN 202210140279.9, filed Feb. 16, 2022, Chinese Office Action; Date of Notification Nov. 30, 2023 (9 pages).
CN 202210140279.9, filed Feb. 16, 2022, English Translation of Chinese Office Action; Date of Notification Nov. 30, 2023 (13 pages).

* cited by examiner

DOUBLE-SIDE OR ONE-SIDE MACHINE TOOL

CROSS REFERENCE TO RELATED INVENTION

This application is based upon and claims priority to, under relevant sections of 35 U.S.C. § 119, German Patent Application No. 10 2021 103 709.3, filed Feb. 17, 2021, the entire contents of which are hereby incorporated by reference.

TECHNOLOGICAL FIELD

The disclosure relates to a double-side or one-side machine tool comprising a preferably annular first working disk which is fastened to a first support disk, and comprising a counter bearing element, wherein the first working disk and the counter bearing element can be driven to rotate relative to each other by at least one drive shaft, wherein a working gap is formed between the first working disk and the counter bearing element to machine both sides or one side of flat workpieces, and wherein first clamping means are provided to clamp the first working disk with a clamping surface facing away from the working gap against a clamping surface of the first support disk facing the first working disk.

BACKGROUND

Flat workpieces such as wafers are simultaneously machined on both sides in double-sided machine tools. For this purpose, double-sided machine tools have a top working disk and a bottom working disk between which a working gap is formed in which the workpieces to be machined are guided during processing. The top working disk is fastened to a top support disk, and the bottom working disk is fastened to a bottom support disk. For machining, a relative rotation between the working disks is produced by rotatably driving at least one of the working disks together with its support disk. Double-sided machine tools are known in which so-called rotor disks are guided. The rotor disks generally accommodate workpieces to be machined in circular openings in a floating manner. By suitable kinematics, it is ensured that the rotor disks also rotate within the working gap during the relative rotation of the working disks. As a result, the workpieces move along cycloid paths within the working gap. Particularly consistent surface machining is hereby achieved.

With machine tools of the kind at issue here, a change in the working gap arises between the working disks due to the process heat which arises during machining. In particular, a heat-related deformation of the working disks occurs and hence a deviation in the gap geometry from the stipulated shape. This negatively influences the result of machining. This applies in particular to the very high machining requirements of so-called prime wafers.

A two-disk polishing machine is known from DE 100 07 390 B4, in particular for machining semiconductor wafers. In this case, cooling channels are formed in a support disk bearing a polishing disk, or in the support disk and in the polishing disk, by which cooling takes place to prevent undesirable influences on the geometry of the working gap. Moreover, a relative radial movement is permitted between a base support and the support disk, whereby a deformation is reduced when temperatures of the base support and support disk differ.

It is known from DE 10 2004 040 429 B4 to counteract negative effects from the arising process heat by controlling the temperature of the working disks. Channels are formed in the support disks through which corresponding temperature-controlling fluid such as cooling water is conducted.

Furthermore, an apparatus for mechanically deforming the top support disk, and with it the top working disk attached thereto, is known from DE 10 2006 037 490 B4. With this apparatus, an initially flat working surface of the top working disk can be changed to a slightly concave surface. Conversely, an initially slightly convex working surface of the top working disk can be changed into a flat, or respectively concave working surface.

A double-side or one-side machine tool is known from DE 10 2016 102 223 A1 with means for the local deformation of at least one of the working disks, in particular by introducing a pressure medium such as for example water into a pressure chamber acting on the working disk. In this manner, for example a local concave or complex deformation of the working disk can be created. Moreover, cooling channels are formed in a support disk of the working disk for cooling. In addition, means can be provided for creating a global deformation as described in DE 10 2006 037 490 B4.

BRIEF SUMMARY OF THE INVENTION

A problem with known systems is that the working disk directly bordering the working gap can heat up more during operation than the support disk bearing it. As a result, stresses can occur between the working disk and the support disk and thus the working gap can no longer be influenced in a reliably controllable manner. Depending on the temperature difference, a mutual displacement between the support disk and the working disk can also occur. During subsequent cooling after operation, the disks do not completely return to their previous position due to a frictional force counteracting the movement, for example from a screwed connection. A force differential can therefore remain between the disks to the amount of twice the frictional force after complete cooling. This can in turn yield different local geometries. Moreover, the global geometry of the working disk can also be changed by the changed bracing between the support disk and working disk. Significant temperature differences can also occur during operation between a side of the working disk bordering the working gap and an opposite side of the working disk. These can lead to different thermal expansions of the two sides, which can cause a bulge in the working disk and therefore also a change in the local geometry.

A heat-related change in geometry could be counteracted by using a material with a very low coefficient of thermal expansion, such as special iron-nickel alloys, for example known as Invar. However, such materials are expensive and difficult to process, in particular cast or machine. The use of such a material would be economically viable only for comparatively thin working disks. A bracing of such a working disk with a support disk made of a material with a greater coefficient of thermal expansion would, however, form a bimetal, such that changes in geometry and correspondingly large bracing forces would occur even in the case of relatively small temperature changes. WO 2020/208968 A1 therefore proposes, when using a working disk material with a low coefficient of thermal expansion, not to brace the working disk with the support disk, but rather only to suspend it on the support disk via a mount. As a result, the contact between the working disk and the support disk is to be minimized. However, the resulting lack of bracing between the support disk and the working disk impairs the machining result.

Proceeding from the explained prior art, the object of the invention is to provide a double-side or one-side machine tool of the type in question which minimizes local or global changes in geometry of the working gap for machining workpieces due to thermal effects.

For a double-side or one-side machine tool of the type in question, the invention achieves the object in that decoupling means are provided for at least partially decoupling the first working disk from the first support disk.

The machine tool can for example be a polishing machine, lapping machine, or a grinding machine. A working gap is formed between the first working disk and a counter bearing element such as a simple weight or pressure cylinder with one-side machine tools, or a second working disk with double-side machine tools, in which workpieces to be machined such as wafers are machined on both sides or one side. The machine tool can be a double-side or a one-side machine tool. With a double-side machine tool, the bottom side and top side of workpieces can be preferably machined simultaneously in the working gap. Correspondingly, both working disks can have a working surface that machines the workpiece surface. With a one-side machine tool, only one workpiece side is contrastingly machined; for example, the bottom side by the bottom working disk. In this case, only one working disk has a working surface that machines the workpiece surface. The counter bearing element in this case only serves to form a corresponding counter bearing for machining by the working disk.

The workpieces can be accommodated for machining to float in a known manner in openings in rotor disks arranged in the working gap. The first working disk and the counter bearing element are driven to rotate relative to each other during operation, for example by a first and/or second drive shaft and at least one drive motor. Both the counter bearing element as well as the first working disk can be driven to rotate, for example in the opposite direction. It is, however, possible to only rotatably drive either the counter bearing element or first working disk. For example, with a double-side machine tool, rotor disks can be moved by suitable kinematics to rotate during this relative rotation through the working gap so that workpieces arranged in the rotor disks describe cycloid paths in the working gap. For example, the rotor disks can have teeth on their outer edge and/or on their inner edge that engage in associated teeth, for example of the first working disk. Such machines with so-called planetary kinematics are well-known.

The first working disk can be configured to be annular. The counter bearing element, or respectively the second working disk, can also be designed annular. The first working disk and the counter bearing element such as the second working disk then possess facing annular working surfaces between which the annular working gap is formed. The working surfaces can be covered with a working covering such as polishing cloths. Any support disks that hold the working disks can also be designed annular, or at least possess annular support sections to which the working disks are fastened. More than one support disk per working disk can also be provided. The first working disk and/or the counter bearing element can be formed in one or more layers. The same applies to a support disk bearing the first working disk or the counter bearing element.

According to an embodiment, the decoupling means, such as one or more s elements, are provided for at least partial, for example complete, decoupling, in particular mechanical decoupling, of the first working disk from the first support disk. The at least partial decoupling caused by the decoupling means is such that the first working disk and the first support disk can move relative to one another more easily, i.e. under reduced frictional force, than without the decoupling means. A virtually free expansion of the working disk and optionally of the support disk is thus possible. In particular, the frictional force, brought about by the first clamping means or first clamping arrangement, between the mutually facing clamping surfaces of the first working disk and the first support disk is reduced. For this purpose, the decoupling means can act on the first clamping means.

In the prior art, attempts have been made to counteract a thermal expansion by means of additional measures, such as cooling or mechanical deformation, in particular to suppress thermal expansion as far as possible. The present invention provides another approach. A thermal change in size is basically permitted, but the decoupling means have the effect that the thermal change in size does not adversely affect the working gap and thus the machining result. Owing to the reduction in the frictional force between the clamping surfaces of the first working disk and the support disk, a thermal change in size of the working disk, for example, during operation therefore does not lead to the problems explained at the outset with respect to a change in geometry of the working gap. As explained, the first working disk and the first support disk are displaced relative to one another, for example when the first working disk is heated during operation, along their clamping surfaces which form corresponding joining surfaces. As also explained, owing to the frictional force caused by the first clamping means, subsequent cooling does not result in a complete return movement to the starting position. There is thus some degree of hysteresis. The decoupling means reduce the frictional force brought about by the first clamping means in such a way that, for example, a complete return movement to the starting position takes place during the cooling that occurs after heating. Corresponding lasting stresses and local or global changes in geometry caused thereby can thus be minimized. At the same time, extensive bracing is realized between the support disk and the working disk, in particular a bracing substantially over the entire surface or the entire radial extension of the first working disk and/or the first support disk. In contrast to such bracing that is lacking in the prior art discussed above, the machining result is therefore not impaired.

In an embodiment, the decoupling means can be arranged between the clamping surfaces of the first working disk and the first support disk. Therefore, it is possible for there to be no direct contact between the clamping surfaces of the first working disk and the first support disk, but rather only indirect contact via the decoupling means. At the same time, working and support disks can be braced against one another over their entire surface, in particular their entire radial extension, for example via clamping screws provided in different radial positions. The decoupling means can also act on the first clamping means itself. It is then possible that although the first working disk bears with its clamping surface directly against the clamping surface of the first support disk, the first clamping means are prestressed, for example, in such a way that a relative movement between the first working disk and the first support disk is possible over the clamping surfaces with a reduced frictional force.

According to an embodiment, it is in particular possible for the clamping surface of the first working disk to bear directly against the clamping surface of the first support disk, without an intermediate layer or an intermediate element being provided between the clamping surfaces. If the decoupling means are arranged between the clamping surfaces of the first working disk and the first support disk, it is possible, apart from the decoupling means, for there to be no intermediate layer or no further intermediate element between the clamping surfaces.

According to a particularly practical embodiment, the decoupling means can comprise at least one bearing, in particular a plurality of such bearings, arranged between the clamping surfaces of the first working disk and of the first support disk. Bearings arranged between the clamping surfaces permit a relative movement between the first working disk and the first support disk with a considerably reduced frictional force by realizing a mechanical decoupling. Rolling bearings, for example roller bearings, are particularly suitable bearings. Such bearings can be arranged, for example, in particular around the clamping means, for example the clamping screws.

According to a further embodiment, the decoupling means may comprise elastic prestressing means for the elastic prestressing of the first clamping means. Such elastic prestressing means can alternatively or additionally be provided for decoupling means, such as bearings, arranged between the clamping surfaces. The elastic prestressing means elastically prestress the first clamping means in such a way that they clamp the clamping surfaces of the first working disk and the first support disk against each other. Against this elastic prestress, the frictional force between the clamping surfaces is reduced when the clamping surfaces are displaced relative to one another in the course of a thermal change in size. As explained, the elastic prestressing means can be provided in addition to decoupling means between the clamping means surfaces, for example at least one bearing between the clamping surfaces. In this case, the elastic prestressing means can prestress the at least one bearing, for example the at least one rolling bearing. An increased freedom of movement between the clamping surfaces of the first working disk and the first support disk can then be provided with elastic deformation of the elastic prestressing means.

According to a further particularly practical embodiment, the first clamping means can comprise clamping screws with which the first support disk is clamped with its clamping surface against the clamping surface of the first working disk. Such clamping screws can be inserted from the side facing away from the working gap into corresponding screw receptacles of the first support disk and of the first working disk. For this purpose, the clamping screws can be guided through the first support disk and screwed into the first working disk. At least in the first working disk, the screw receptacles can have a corresponding screw thread. The screw head of the clamping screws can bear against the side of the first support disk facing away from the first working disk. For bracing, a plurality of clamping screws can be provided. For example, in the case of an annular first working disk, a first group of clamping screws is arranged along a radially outer partial circle of the first working disk or the first support disk, and a second group of clamping screws is arranged along a radially inner partial circle of the first working disk or the first support disk. The partial circles can each be arranged close to the radially outer or radially inner end of the first working disk or the first support disk.

According to a further embodiment in this regard, the elastic prestressing means can comprise elastic spring washers, which are each arranged between a screw head of the clamping screws and a surface of the first support disk facing away from the first working disk. The spring washers can be clamped between the screw head and the facing side of the support disk and can thereby be elastically compressed and thus prestressed. Against this prestress, the frictional force between the clamping surfaces of the first working disk and the first support disk can be reduced.

According to a further embodiment, the decoupling means can comprise a decoupling intermediate layer between the first working disk and the first support disk. This may be, for example, a sliding intermediate layer, for example of a particularly sliding material, such as Teflon®. However, it can also be an intermediate layer for thermal decoupling, which accordingly has a low thermal conductivity. The decoupling means can thus also be thermal decoupling means.

According to a further embodiment, the material of the first working disk can have a lower coefficient of thermal expansion than the material of the first support disk. The coefficient of thermal expansion of the first working disk can in particular be substantially less than the coefficient of thermal expansion of the first support disk, for example lower by a factor of 5, preferably lower by a factor of ten (10). As explained at the outset, the use of materials with greatly different coefficients of thermal expansion for the first support disk and the first working disk leads to a bimetal and changes in geometry caused thereby in the event of a thermal change in size. Owing to the at least partial decoupling according to the invention between the first working disk and the first support disk, there are no significant stresses between the first working disk and the first support disk even in the case of greatly different coefficients of thermal expansion of the first working disk and the first support disk. As a result, the problems explained at the beginning with regard to a bimetal can be avoided. It is thus possible, in particular only for the first working disk, to use a material with a very low coefficient of thermal expansion, for example an iron-nickel alloy, such as Invar, while a conventional material having a higher coefficient of thermal expansion, for example cast iron, is used simultaneously for the first support disk. A geometry which is largely independent of the process heat can then be generated. At the same time, the use of a material with a very low coefficient of thermal expansion for the working disk is advantageous with regard to the geometrical stability of the working disk and thus of the working gap.

According to a further embodiment, the counter bearing element can be formed by a preferably annular second working disk, wherein the first and second working disks are arranged coaxially with respect to one another, and wherein the working gap is formed between the first working disk and the second working disk for machining both sides or one side of flat workpieces. The second working disk can be fastened to a second support disk, wherein second clamping means are provided for clamping the second working disk with a clamping surface facing away from the working gap against a clamping surface of the second support disk facing the second working disk, and wherein decoupling means or decoupling elements are also provided for at least partially decoupling the second working disk from the second support disk. The second clamping means can be designed, for example, as the first clamping means. The second working disk and/or the second support disk can be designed like the first working disk or the first support disk. The decoupling means for decoupling the second work disk from the second support disk can also be designed like the decoupling means for decoupling the first working disk from the first support disk. In this respect, all of the exemplary embodiments explained in this context can be transferred to the second working disk and the second support disk with the second clamping means and their decoupling means.

According to a further embodiment, a preferably annular pressure volume can be formed between the first support disk and the first working disk. The pressure volume is connected to a pressure fluid supply that is actuable such that a pressure is built up in the pressure volume that generates a predetermined local deformation of the first working disk. To the extent that the term fluid is used in this application, it can designate both a gas as well as a liquid. The pressure fluid can be a liquid, in particular water. By introducing the pressure fluid into the pressure volume, pressure can be exerted on the working disk, which is thin compared to the support disk, said pressuring leading to a deformation of the working disk. In particular, the working disk can be thereby changed to a locally concave shape by setting a low pressure in the pressure volume, to a locally flat shape by setting a medium pressure, and to a locally convex shape by setting a high pressure. The locally convex, or respectively concave deformation, or respectively shape, lies between the inner and outer edge of the annular first working disk, in particular in the radial direction. The pressure volume is a changeable pressure volume. The first working disk forms a membrane that deforms depending on the volume of the pressure volume produced by the different pressure.

The pressure fluid supply comprises a pressure fluid reservoir to which is connected at least one pressure line that is connected to the pressure volume. A pump and a control valve can be arranged in the pressure line that can be actuated to build up the desired pressure within the pressure volume, for example by a control and/or regulation apparatus. In addition, the pressure fluid supply can comprise a pressure measuring apparatus that directly or indirectly measures the pressure in the pressure volume and can also send the measurements to the control and/or regulation apparatus. By suitably actuating the pressure fluid supply in the pressure volume, the required pressure for the desired working gap geometry can be adjusted on this basis. An unchanging distance between the working disks over the entire radial extension is for example desirable. The desired gap geometry can be adjusted in static operation and/or in dynamic operation, i.e., while machining a workpiece.

With the pressure volume, a smooth adjustment of the local shape of the first working disk between a maximum concave to maximum convex shape determined by the installation, geometric and material boundary conditions is basically possible. The first working disk can in principle have any thickness. Depending on the desired adjustment range of the disk geometry, the working disk possesses a suitable thickness so that it can be deformed with the available pressure depending on its surface area in particular its ring width, or respectively its turning radius. As explained in DE 10 2016 102 223 A1, the possibility of adjusting the local geometry of the first working disk in a radial direction can compensate for a change in the gap from the influence of temperature during machining.

According to a further embodiment, it is possible for temperature-controlling channels to be provided for controlling the temperature of the first working disk, which temperature-controlling channels are connected to a temperature-controlling fluid supply. The temperature-controlling channels are designed to conduct a temperature-controlling fluid. They can for example be designed like a labyrinth. A temperature-controlling fluid, for example a temperature-controlling liquid such as water can be guided through the temperature-controlling channels while the machine is operating to control the temperature, in particular to cool the working disk. A heat-related deformation of the working disk can be counteracted to a certain extent by the temperature-controlling channels.

According to a further embodiment, it is possible for the temperature-controlling channels to be arranged within the first working disk, such that the temperature-controlling channels are arranged closer to the working gap than the pressure volume, and that the temperature-controlling channels are not connected to the pressure volume. Owing to the arrangement of the temperature-controlling channels within the first working disk, in particular exclusively within the first working disk, the temperature-controlling channels can be arranged closer to the working gap than the pressure volume. In particular, only one feed and discharge line for the temperature-controlling fluid can run through the support disk that are connected to the temperature-controlling fluid supply. Owing to the temperature-controlling channels arranged closer to the working gap, the cooling of the first working disk is more effective, so particularly the above-explained problems of stronger heating of the working disk than the support disk and stronger heating of a side of the working disk bordering the working gap can be minimized. Corresponding stresses between the first working disk and the first support disk as well as undesired deformations of the first working disk can also be minimized. In fact, the temperature-controlling channels are disposed as close as possible to the surface of the working disk bordering the working gap so that penetration of the process heat through the working disk into the support disk can be prevented. In order to further minimize the transfer of heat between the first working disk and first support disk, it is possible to provide the first support disk and/or the first working disk in the region of their contact with bars or other elevations so that the contact surface between the disks is minimized.

In addition, in this embodiment, the temperature-controlling channels are not connected to the pressure volume, also unlike in the prior art, in which they are connected to one another and form a common circuit. Separate fluid systems (circuits) for the temperature-controlling channels on the one hand and for the pressure volume on the other hand are thus provided. This enables a more flexible adjustment of the pressure in the pressure volume independent of the pressure in the temperature-controlling channels. In addition, the useful pressure in the pressure volume for adjusting the local geometry is not limited by the pressure in the temperature-controlling channels in contrast to the prior art.

According to another embodiment, it is possible for the first working disk to be formed from two preferably annular disks that are connected to each other, between which the temperature-controlling channels are formed, wherein one of the disks borders the working gap and the other of the disks comprises the clamping surface for clamping against the clamping surface of the first support disk. The first working disk is therefore constructed in two parts, wherein it forms the temperature-controlling channels between the two partial disks similar to a sandwich construction. This design makes the formation of the temperature-controlling channels exclusively within the first working disk very easy in terms of construction. According to a particularly practical embodiment, the two disks can be screwed to each other. However, other types of fastening are of course also conceivable.

According to another embodiment, it is possible for the first working disk to be fastened only in the region of its outer edge and in the region of its inner edge to the first support disk. As already explained, the working disks can particularly be annular. The preferably annular pressure volume is then formed between the first working disk and the first support disk. In the aforementioned embodiment, the first working disk is only fastened to the first support disk in the region of its radially outer edge and radially inner edge bordering the working surface, for example screwed along a partial circle using clamping screws as clamping means. Between these edge regions, the working disk is contrastingly not fastened to the support disk. In particular, the pressure volume can be formed within this region. In this manner, the working disk possesses the required mobility in order to be deformed in the desired manner by building up a suitable pressure in the pressure volume. The attachment of the working disk to the support disk is selected so that the contact surface on the inner and outer edge is kept as narrow as possible in order to achieve a specific deformation over the entire surface of the working disk if possible.

BRIEF DESCRIPTION OF THE DRAWINGS

Exemplary embodiments of the invention are explained in greater detail below based on figures. Schematically.

The same reference signs refer to the same objects in the figures unless indicated otherwise.

DETAILED DESCRIPTION OF THE INVENTION

Figure 1:
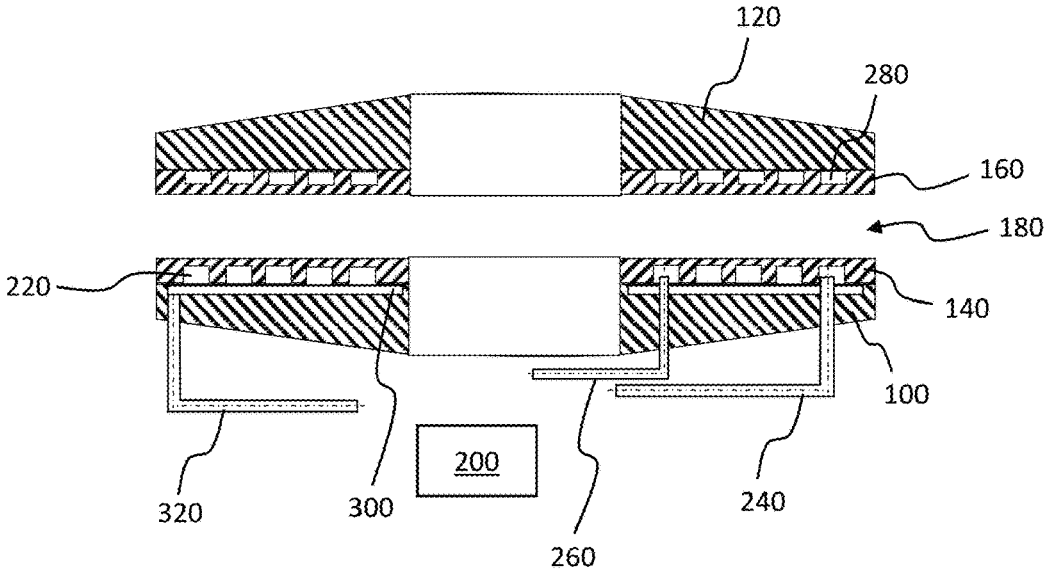
FIG. 1 illustrates a sectional view of an embodiment of a portion of a double-side machine tool.

The double-side machine tool depicted merely as an example in FIG. 1 has an annular first, bottom support disk 100 and a second, top support disk 120 that is also annular. An annular first, bottom working disk 140 is fastened to the bottom support disk 100, and a second, top working disk 160 that is also annular is fastened to the top support disk 120. Between the annular working disks 140, 160, an annular working gap 180 is formed in which flat workpieces such as wafers are machined on both sides during operation. The double-side machine tool can for example be a polishing machine, lapping machine, or a grinding machine.

The top support disk 120, and with it the top working disk 160, and/or the bottom support disk 100 and with it the bottom working disk 140, can be rotatably driven relative to each other by a suitable drive apparatus comprising for example a top drive shaft, and/or a bottom drive shaft 38, as well as at least one drive motor. The drive apparatus is known per se and will not be described further for reasons of clarity. In a manner which is also known per se, the workpieces to be machined can be held to float in rotor disks in the working gap 180. By suitable kinematics, for example planetary kinematics, it can be ensured that the rotor disks also rotate through the working gap 180 during the relative rotation of the support disks 100, 120, or respectively working disks 140, 160. A control and/or regulation apparatus 200 controls, or respectively regulates the operation of the double-side machine tool.

In the example shown in FIG. 1, labyrinth-like temperature-controlling channels 220 are provided within the bottom working disk 140. The temperature-controlling channels 220 are connected by a feed 240 and a discharge 260, for example via a drive shaft driving the bottom support disk 100 and the bottom working disk 140, to a temperature-controlling fluid supply. The control and/or regulation apparatus 200 can be used, for example, to regulate to a predetermined temperature value of the temperature-controlling fluid at the inlet and/or at the outlet of the temperature-controlling channels or to a predetermined temperature difference between the temperature present at the inlet and the temperature present at the outlet of the temperature-controlling channels by correspondingly adjusting the temperature of the temperature-controlling fluid. In the shown example, labyrinthine temperature-controlling channels 280 are also formed in the top working disk 160 that are also connected to a temperature-controlling fluid supply via a feed and discharge (not shown). This temperature-controlling fluid supply is also controlled by the control and/or regulation apparatus 200. By supplying the temperature-controlling channels 220, or respectively 280 with a temperature-controlling fluid, for example a coolant such as water, heating of the working disks 140, 160 and transfer of heat into the support disks 100, 120 can be effectively counteracted so that corresponding changes in geometry are reduced.

Moreover, a pressure volume 300 that is annular in the example shown is formed between the bottom support disk 120 and the bottom working disk 160 and is connected via a feed 320, for example also via a drive shaft 38 driving the bottom support disk 100 and the bottom working disk 140, to a pressure fluid supply. The pressure fluid supply is also actuated by the control and/or regulation apparatus 200. By correspondingly introducing pressure fluid into the pressure volume 300, a local deformation of the bottom working disk 140 can be created, in particular a local concave or convex deformation as described in principle in DE 10 2016 102 223 A1.

As can be seen in FIG. 1, the temperature-controlling channels 220 are arranged closer to the working gap 180 than the pressure volume 300. Moreover, the duct systems of the pressure volume 300 and the temperature-controlling channels 220 are not connected to each other, but are instead separately controllable, or respectively regulatable.

Figure 2:
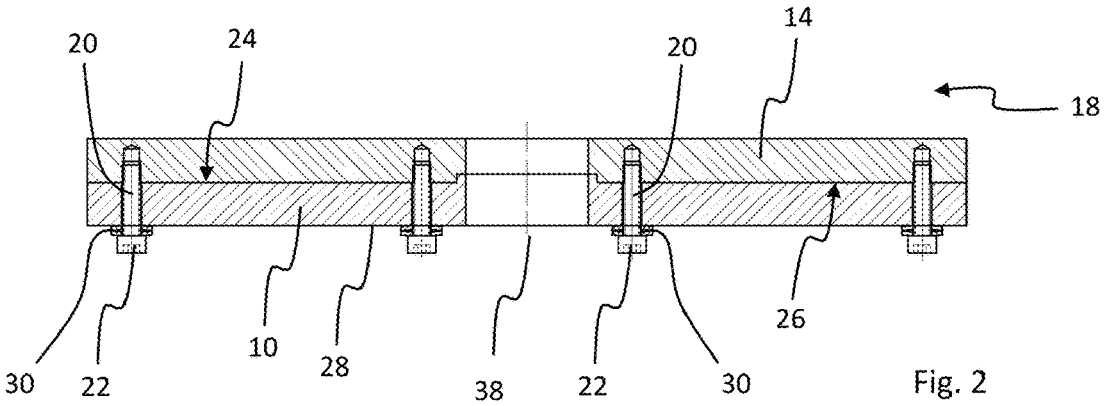
FIG. 2 illustrates a sectional view of an embodiment of a first working disk and an embodiment of a first support disk of an embodiment of a double-side machine tool.
Figure 3:
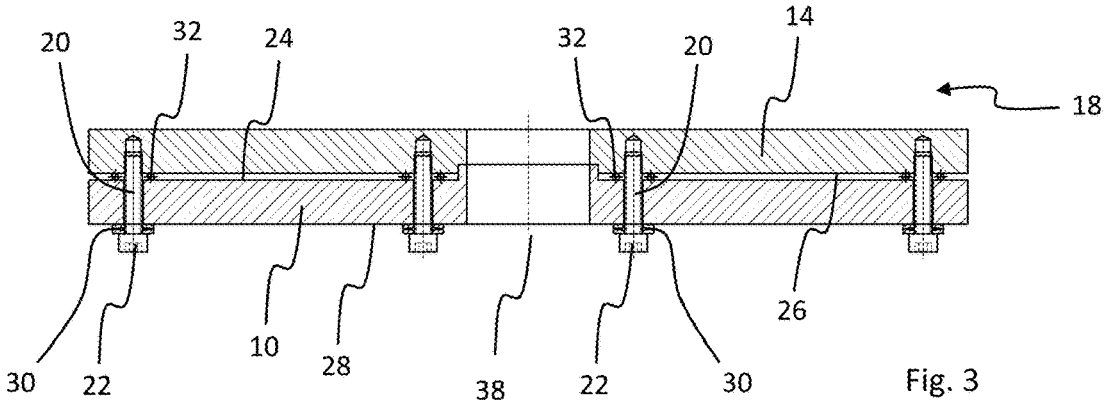
FIG. 3 illustrates a sectional view of another embodiment of the first working disk and the first support disk of a double-side machine tool.
Figure 4:
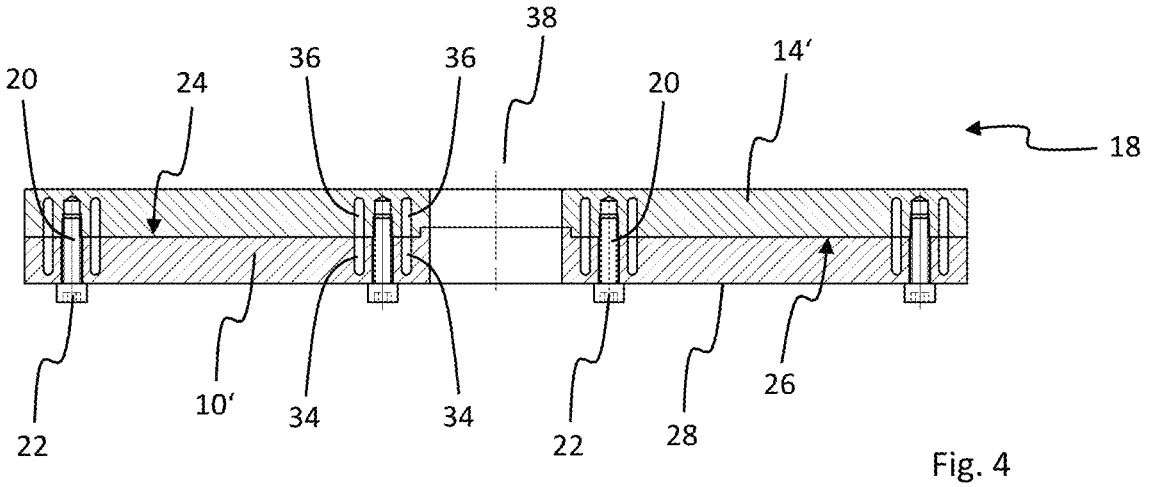
FIG. 4 illustrates a sectional view of still another embodiment of the first working disk and the first support disk of a double-side machine tool.

FIGS. 2 to 4 each show a first support disk and a first working disk which can be used in the double-side machine tool shown in FIG. 1. For reasons of illustration, FIGS. 2 to 4 do not show the temperature-controlling channels 220 and the pressure volume 300 as shown in FIG. 1, including the associated feed and discharge lines. It goes without saying that the working disks and support disks shown in FIGS. 2 to 4 can also have corresponding temperature-controlling channels and pressure volumes, including the feed and discharge lines. In addition, FIGS. 2 to 4 show only a first support disk and a first working disk for the sake of illustration. The second support disks and second working disks, which are provided in addition, can be designed accordingly.

FIG. 2 shows a first exemplary embodiment of a first, bottom support disk 10 and a first, bottom working disk 14, which can be used, for example, in the double-side machine tool shown in FIG. 1. In the exemplary embodiment shown, a plurality of clamping screws 20 are provided, which are inserted through the first support disk 10 from a side facing away from the working gap 18 and are screwed into a corresponding threaded bore in the first working disk 14.

The clamping screws are arranged along two partial circles via the annular support and working disks 10, 14, namely a radially outer partial circle and a radially inner partial circle. The clamping screws 20 each have a screw head 22. The first support disk 10 has a clamping surface 24 facing the first working disk 14 and the first working disk 14 has a clamping surface 26 facing the first support disk 10. During the screwing-in of the clamping screws 20, the first support disk 10 and the first working disk 14 are braced against one another. In the illustrated exemplary embodiment according to FIG. 2, the clamping surfaces 24, 26 lie directly against one another in the braced state and are braced against one another.

In the exemplary embodiment according to FIG. 2, elastic spring washers 30 are disposed between the screw heads 22 of the clamping screws 20 and a surface 28 of the first support disk 10 facing away from the first working disk 14, which spring washers are elastically compressed in the screwed-in state of the clamping screws 20 and thus elastically prestress the clamping means 20. As a result, in the case of a thermally induced relative movement between the first support disk 10 and the first working disk 14 over the clamping surfaces 24, 26, the frictional force provided by the clamping means 20 is reduced, such that, for example, after a thermal expansion of the first working disk 14 and a relative movement caused thereby with respect to the first support disk 10, the first working disk 14 moves back completely into its original position.

FIG. 3 shows a further exemplary embodiment which largely corresponds to the exemplary embodiment according to FIG. 2. In addition to the elastic spring washers 30, in the exemplary embodiment according to FIG. 3, rolling bearings 32 arranged around the clamping screws 20 are provided between the clamping surfaces 24, 26 of the first support disk 10 and the first working disk 14. By means of these rolling bearings 32, the first support disk 10 and the first working disk 14, in particular their clamping surfaces 24, 26, are mechanically decoupled from one another. Accordingly, the frictional force between the first support disk 10 and the first working disk 14 which is caused by the clamping screws 20 is further reduced.

FIG. 4 shows a further example for seeking to avoid the effects of thermal changes in size explained above. The example according to FIG. 4 differs from the exemplary embodiment according to FIG. 2 on the one hand in that no decoupling means or decoupling elements are provided in the form of the elastic spring washers 30. On the other hand, it differs in that relief grooves 34, 36 are formed around the clamping screws 20 in the first support disk 10' and the first working disk 14'. Attempts have been made to counteract the disadvantageous effects of the thermal change in size explained above by means of such relief grooves 34, 36. However, it has been found that this measure does not yield the success associated with the decoupling means according to FIGS. 2 and 3.

LIST OF REFERENCE SIGNS

10, 10', 100 Bottom support disk
12, 120 Top support disk
14, 14', 140 Bottom working disk
16, 160 Top working disk
18, 180 Working gap
20 Clamping screw
22 Screw head
24 Clamping surface
26 Clamping surface
28 Surface
30 Spring washer
32 Rolling bearing
34 Relief grooves
36 Relief grooves
38 Bottom drive shaft
200 Control and/or regulation apparatus
220 Temperature-controlling channels
240 Feed
260 Discharge
280 Temperature-controlling channels
300 Pressure volume
320 Feed

The invention claimed is:

1. A machine tool comprising:

a first support disk comprising a clamping surface;

a first working disk fastened to the first support disk, wherein the first working disk comprises a clamping surface;

a counter bearing element, wherein a working gap dimensioned to accept a flat workpiece is defined between the first working disk and the counter bearing element;

a first clamping arrangement comprising a plurality of clamping screws configured to clamp the clamping surface of the first working disk to the clamping surface of the first support disk, wherein the clamping surface of the first working disk faces away from the working gap; and at least one decoupling element configured to reduce friction between the first support disk and the first working disk and enable thermally induced movement of the working disk from an original position relative to the support disk and a return of the working disk to the original position after the thermally induced movement, wherein the at least one decoupling element comprises:

at least one bearing arranged between the clamping surface of the first working disk and the first support disk, wherein the at least one bearing comprises at least one rolling bearing, and a plurality of elastic spring washers, each spring washer of the plurality of elastic spring washers is positioned between a screw head of each of the plurality of clamping screws and a surface of the first support disk facing away from the first working disk, wherein each elastic spring washer of the plurality of elastic spring washers is configured to prestress the first clamping arrangement;

wherein the first working disk and the counter bearing element are configured to be driven to rotate relative to each other by at least one drive shaft, and wherein the first working disk and the counter bearing element are configured to machine at least one side of the flat workpiece.

2. The machine tool according to claim 1, wherein the spring washers are configured to elastically prestress the first clamping arrangement.

3. The machine tool according to claim 1, wherein the at least one decoupling element comprises a decoupling intermediate layer located between the first working disk and the first support disk.

4. The machine tool of claim 3, wherein the decoupling intermediate layer comprises one of: (1) a sliding intermediate layer; and (2) an intermediate layer for thermal decoupling.

5. The machine tool according to claim 1, wherein the first working disk comprises a first material and the first support disk comprises a second material, wherein the first material comprises a lower coefficient of thermal expansion than the second material.

6. The machine tool according to claim 1, wherein the counter bearing element is a second working disk, wherein the first and second working disk are arranged coaxially relative to each other, and wherein the working gap is defined between the first and second working disk.

7. The machine tool according to claim 6, wherein:

the second working disk defines a clamping surface;

the second working disk is fastened to a second support disk using at least one second clamping element such that the clamping surface faces away from the working gap; and at least one decoupling element is configured to at least partially decouple the second working disk from the second support disk.

8. The machine tool according to claim 1, further comprising a pressure volume defined between the first support disk and the first working disk, wherein the pressure volume is connected to a pressure fluid supply, and wherein the pressure fluid supply is configured to generate a pressure is build up in the pressure volume to cause a predetermined deformation of the first working disk.

9. The machine tool according to claim 8, further comprising temperature-controlling channels configured to control a temperature of the first working disk, wherein the temperature-controlling channels are connected to a temperature-controlling fluid supply.

10. The machine tool according to claim 9, wherein the temperature-controlling channels are arranged within the first working disk at a position that is closer to the working gap than the pressure volume, and wherein that the temperature-controlling channels are not connected to the pressure volume.

11. The machine tool according to claim 9, wherein the first working disk is formed from two annular disks which are connected to one another, wherein the temperature-controlling channels are formed between the two annular disks, and wherein a first of the two annular disks borders the working gap and a second of the two annular disks comprises the clamping surface for clamping to the clamping surface of the first support disk.

* * * * *